US007990402B2

(12) United States Patent
Yamamoto et al.

(10) Patent No.: US 7,990,402 B2
(45) Date of Patent: Aug. 2, 2011

(54) IMAGE DISPLAY CONTROL DEVICE

(75) Inventors: Takekuni Yamamoto, Suwa-gun (JP); Kenji Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 895 days.

(21) Appl. No.: 11/980,614

(22) Filed: Oct. 31, 2007

(65) Prior Publication Data

US 2008/0143756 A1 Jun. 19, 2008

(30) Foreign Application Priority Data

Nov. 10, 2006 (JP) ..... 2006-304667
Oct. 19, 2007 (JP) ..... 2007-272738

(51) Int. Cl.
*G09G 5/10* (2006.01)

(52) U.S. Cl. ..... 345/690; 345/89; 345/102; 345/207

(58) Field of Classification Search ..... 345/87–102, 345/204–215, 690
See application file for complete search history.

(56) References Cited

U.S. PATENT DOCUMENTS 7,133,070 B2 * 11/2006 Wheeler et al. ..... 348/223.1
7,202,850 B2 4/2007 Kitagawa
7,728,845 B2 * 6/2010 Holub ..... 345/589
7,737,933 B2 * 6/2010 Yamano et al. ..... 345/94
2003/0095197 A1 * 5/2003 Wheeler et al. ..... 348/241
2004/0066363 A1 * 4/2004 Yamano et al. ..... 345/98
2004/0213457 A1 10/2004 Mori
2005/0184952 A1 8/2005 Konno et al.
2005/0286061 A1 * 12/2005 Kurumisawa ..... 358/1.9
2006/0280360 A1 * 12/2006 Holub ..... 382/162

FOREIGN PATENT DOCUMENTS

JP A-11-065531 3/1999
JP A-2004-191950 7/2004
JP A-2004-310671 11/2004
JP A-2005-258403 9/2005

OTHER PUBLICATIONS

U.S. Appl. No. 11/980,652, filed Oct. 31, 2007, in the name of Takekuni Yamamoto.
U.S. Appl. No. 11/980,685, filed Oct. 31, 2007 in the name of Takekuni Yamamoto.

* cited by examiner

*Primary Examiner* — Vijay Shankar
(74) *Attorney, Agent, or Firm* — Oliff & Berridge, PLC

(57) ABSTRACT

An image display control device calculates a lighting luminance after reduction in luminance and an image correction coefficient by real-time calculations of a common calculator. The common calculator is controlled by microcodes stored in a code table. When correcting an image, chroma correction is enhanced to suppress a decrease in chroma due reduction in luminance, and a flicker is prevented by series infinite impulse response (IIR) filtering processes. When the image has a low average luminance but has a high chroma, a decrease in chroma is suppressed by limiting a reduction in lighting luminance.

8 Claims, 11 Drawing Sheets

: REDUCTION IN POWER CONSUMPTION IS SMALL

: REDUCTION IN POWER CONSUMPTION IS NORMAL

: REDUCTION IN POWER CONSUMPTION IS LARGE

Δ Gy (Gy' -Gy): INCREASE IN AMOUNT OF IMAGE CORRECTION ACCOMPANYING LUMINANCE ADJUSTMENT

IMAGE DISPLAY CONTROL DEVICE

Japanese Patent Application No. 2006-304667 filed on Nov. 10, 2006 and Japanese Patent Application No. 2007-272738 filed on Oct. 19, 2007, are hereby incorporated by reference in their entirety.

BACKGROUND OF THE INVENTION

The present invention relates to an image display control device and the like. More particularly, the invention relates to an image display control device (image display control LSI) which adaptively reduces the luminance of display lighting corresponding to a display image and corrects an image signal to compensate for deterioration in image quality due to a reduction in luminance, and the like.

JP-A-11-65531 discloses technology which reduces the quantity of light emitted from a backlight aimed at reducing power consumption, and adjusts image data to increase the transmissivity of a liquid crystal display screen as much as possible.

JP-A-2004-310671 discloses an image correction device which uses a look-up table (LUT) in order to correct a luminance signal of a display image.

In order to simultaneously perform a reduction in luminance of lighting (e.g., backlight) and image correction aimed at preventing deterioration in image quality, it is necessary to perform a large number of calculations based on image data. Calculations may be simplified by utilizing a look-up table (LUT) which stores calculation results. However, memory access takes time. Therefore, this method cannot be used when a high-speed capability is required. For example, a method using an LUT is not suitable when a real-time capability is required, such as when reproducing a streaming image distributed by one-segment broadcasting (digital broadcasting for portable telephone terminals) using a portable telephone terminal.

A high-speed capability (real-time capability) can be ensured by causing a plurality of pieces of dedicated hardware to perform specific calculations in parallel. However, the occupied area and the power consumption of the circuit are inevitably increased.

JP-A-11-65531 takes only luminance correction into consideration during image correction which compensates for deterioration in image quality due to a reduction in lighting luminance. However, since the image quality significantly deteriorates when the chroma (color brightness (vividness)) of the image is impaired due to a reduction in lighting luminance, image correction taking not only the luminance but also the chroma into consideration is necessary.

When the amount of reduction in lighting luminance is adaptively determined corresponding to the luminance of the display image, the lighting luminance quickly changes to follow a quick change in luminance of the display image, whereby a flicker occurs. As a result, the image quality of the display image may deteriorate. In particular, since the luminance of an image frequently changes momentarily when reproducing a streaming image, a flicker (visual flicker) may occur. Therefore, it is necessary to suppress a flicker accompanying a scene change.

SUMMARY

According to one aspect of the invention, there is provided an image display control device that adaptively reduces a luminance of image display lighting corresponding to a display image and corrects an image signal to compensate for deterioration in image quality due to the reduction in the luminance of the lighting, the image display control device comprising:

a statistical information acquisition section that acquires statistical information of the image signal;

a common calculator that calculates the luminance of the lighting after reduction in luminance using the statistical information of the image signal supplied from the statistical information acquisition section, and generates a correction coefficient to correct the image signal;

a code storage section that stores a plurality of codes, the plurality of codes specifying an operation procedure of the common calculator;

a sequence instruction section that controls an order of output of the plurality of codes from the code storage section; and a decoder that decodes the plurality of codes output from the code storage section and generates at least one of an instruction and data supplied to the common calculator.

According to another aspect of the invention, there is provided a driver device of an electro-optical device, the driver device including the above image display control device.

According to a further aspect of the invention, there is provided a control device of an electro-optical device, the control device including the above image display control device.

According to a further aspect of the invention, there is provided a drive control device of an electro-optical device, the drive control device including the above image display control device.

According to a further aspect of the invention, there is provided an electronic instrument including the above image display control device.

DETAILED DESCRIPTION OF THE EMBODIMENT

Figure 1A:
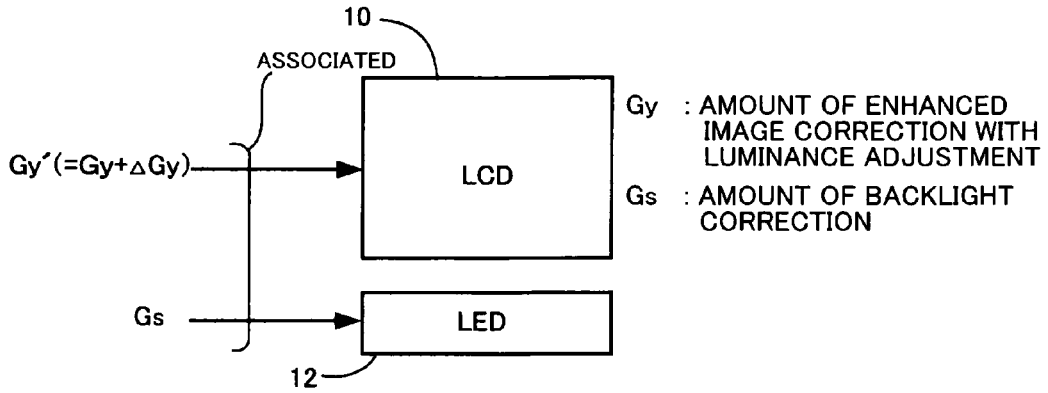
FIGS. 1A to 1C are views illustrative of adaptive luminance adjustment corresponding to a display image and image correction employed in an image display control device (image display control LSI) according to the invention.

Aspects of the invention may implement an adaptive reduction in lighting luminance and a highly accurate image correction which compensates for deterioration in image quality due to a reduction in lighting luminance at the same time while achieving a high-speed process (real-time process) and a reduction in power consumption of a circuit and suppressing an increase in circuit scale.

(1) According to one embodiment of the invention, there is provided an image display control device that adaptively reduces a luminance of image display lighting corresponding to a display image and corrects an image signal to compensate for deterioration in image quality due to the reduction in the luminance of the lighting, the image display control device comprising:

a statistical information acquisition section that acquires statistical information of the image signal;

a common calculator that calculates the luminance of the lighting after reduction in luminance using the statistical information of the image signal supplied from the statistical information acquisition section, and generates a correction coefficient to correct the image signal;

a code storage section that stores a plurality of codes, the plurality of codes specifying an operation procedure of the common calculator;

a sequence instruction section that controls an order of output of the plurality of codes from the code storage section; and a decoder that decodes the plurality of codes output from the code storage section and generates at least one of an instruction and data supplied to the common calculator.

An adaptive reduction in lighting luminance and image correction are implemented by real-time calculations of the common calculator. The image correction coefficient and the lighting luminance after reduction in luminance are calculated in real time by the calculations of the common calculator, and image correction using the calculated correction coefficient is performed. The calculations of the common calculator are controlled by microcodes which specify a signal processing procedure. Real-time calculations can be implemented without parallelly providing the same type of hardware by utilizing the common calculator, whereby high-speed luminance adjustment control and image correction can be implemented using a minimum number of circuits and with minimum power consumption.

(2) In the image display control device according to this embodiment, the code storage section sequentially may output the plurality of codes in the order specified by the sequence instruction section, the decoder may supply the instruction or the data generated as a result of decoding to the common calculator, and the common calculator may determine the luminance of the lighting after reduction in luminance and may generate the correction coefficient to correct the image signal using the instruction or the data, and may output the image signal corrected using the correction coefficient and a signal that indicates the luminance of the lighting after reduction in luminance.

The above configuration specifies the generation procedure of the instruction (operand) and data (e.g., multiplication coefficient) supplied to the common calculator. The sequence instruction section specifies a code table which stores the microcodes, and the codes are sequentially output. An instruction and data are generated by decoding the codes, and supplied to the common calculator. The lighting luminance after reduction in luminance and the correction coefficient are generated by calculations of the common calculator, and output in parallel. The lighting luminance after reduction in luminance and the correction coefficient can be quickly and efficiently generated using the most simplified configuration.

(3) In the image display control device according to this embodiment, the common calculator may include a first multiplexer and a second multiplexer, an arithmetic logic unit, and a distributor that distributes calculation results of the arithmetic logic unit, and the decoder may supply a coefficient to the first multiplexer and the second multiplexer, may supply an operation code to the arithmetic logic unit, and may supply destination information to the distributor.

The above configuration gives an example of a specific configuration of the common calculator, and also specifies the instruction or data supplied to each element. According to this embodiment, the common calculator includes a plurality of multiplexers, an arithmetic logic unit (ALU), and a distributor. A coefficient used for calculations is supplied to the multiplexers, an instruction (operation code) is supplied to the ALU, and destination information is supplied to the distributor.

(4) In the image display control device according to this embodiment, the common calculator may further include:

a plurality of output destination registers; and a feedback path, signals stored in the plurality of output destination registers being at least partially fed back to an input side of the calculator through the feedback path.

The above configuration specifies that the common calculator includes the feedback path through which the calculation results are fed back to the input side. For example, it is possible to perform a process in which the lighting luminance after reduction in luminance is calculated by a first calculation process, the calculation results are fed back to the input side, and the image correction coefficient is calculated based on the calculated lighting luminance. An infinite impulse response (IIR) filtering process can also be performed by providing the feedback path in the common calculator.

(5) In the image display control device according to this embodiment, the statistical information acquisition section may acquire a statistical value of a luminance and a statistical value of a chroma of the image signal, and the image display control device may correct the image signal using the correction coefficient by performing an enhancement of the luminance of the image signal corresponding to the reduction in the luminance of the lighting and an enhancement of the chroma of the image signal corresponding to the reduction in the luminance of the lighting.

When correcting an image accompanying a reduction in luminance, the image quality may deteriorate due to a decrease in chroma when merely enhancing the luminance. Specifically, since the entire color gamut is reduced due to a reduction in lighting luminance, the chroma inevitably decreases. According to this embodiment, image correction is performed in which the chroma (red chroma (Cr) and blue chroma (Cb)) is also enhanced in addition to the luminance. For example, chroma correction is enhanced so that the average chroma remains the same as much as possible before and after luminance adjustment. This prevents deterioration in image quality of a vivid image.

(6) In the image display control device according to this embodiment, the statistical information acquisition section may acquire a statistical value of a luminance of the image signal and a statistical value of a chroma of the image signal, and when calculating the luminance of the lighting after reduction in luminance, the image display control device may determine whether to give priority to either a reduction in the luminance of the lighting or prevention of a decrease in the chroma based on a relationship between the statistical value of the luminance and the statistical value of the chroma, and may perform luminance reduction control while limiting a reduction in the luminance of the lighting when the image display control device has determined to give priority to prevention of a decrease in the chroma.

When adaptively reducing the luminance of lighting (e.g., backlight) based on the statistical information of the image, if the amount of reduction in luminance is determined merely based on the luminance, the brightness (vividness) of red (R) and blue (B) may be impaired due to too large a reduction in luminance. Specifically, since a dark image is affected by a reduction in luminance to a small extent, the luminance is reduced to a large extent. On the other hand, when a large and bright rose or the like is displayed at the center of a dark image, the amount of reduction in luminance is appropriately limited in order to suppress a decrease in chroma of the rose. However, since red (R) and blue (B) contribute to the luminance (Y) to a small extent, the lighting luminance may be reduced to a large extent when the amount of reduction in luminance is determined merely based on the luminance (Y) (i.e., the image is determined to be a dark image). In order to prevent such an excessive reduction in luminance, the amount of reduction in luminance is determined based on the luminance (Y) and the chroma (red chroma (Cr) and blue chroma (Cb)). When the luminance and the chroma satisfy a specific relationship, the amount of reduction in luminance is limited as a result of giving priority to the chroma. This suppresses a reduction in luminance when the image has a high chroma, whereby a decrease in chroma of the display image is suppressed.

(7) In the image display control device according to this embodiment, the image display control device may perform a first infinite impulse response filtering process and a second infinite impulse response filtering process during correction that reduces the luminance of the lighting and correction of the image signal using the correction coefficient, respectively, and a time constant of the first infinite impulse response filtering process performed during the correction that reduces the luminance of the lighting may be set to be larger than a time constant of the second infinite impulse response filtering process performed during the correction of the image signal.

When adaptive lighting luminance adjustment and image correction are performed in each frame of a video image, a visual flicker occurs due to sudden changes in lighting luminance and the amount of image correction accompanying a scene change. Therefore, luminance correction and image correction calculated in frame units are appropriately filtered depending on their characteristics. Specifically, since a change in lighting luminance is a change in black and white and is easily observed visually, a filtering process with a large time constant is performed. On the other hand, since a change in the amount of image correction is a change in halftone and is observed with difficulty, a filtering process with a small time constant is performed taking a quick response to a scene change in a video image into consideration. This makes it possible to effectively suppress a flicker accompanying adaptive luminance correction while achieving image correction which follows a scene change in a video image.

(8) In the image display control device according to this embodiment, the image display control device may calculate the luminance of the lighting after reduction in luminance by performing control of reducing the luminance of the lighting including the first infinite impulse response filtering process based on at least one of the statistical value of the luminance and the statistical value of the chroma, and then may perform correction of the image signal including the second infinite impulse response filtering process based on the calculated luminance of the lighting.

When independently performing the first infinite impulse response filtering process and the second infinite impulse response filtering process, the balance between lighting correction and image correction may be impaired, whereby the image quality may deteriorate. Therefore, the first infinite impulse response filtering process is performed on the lighting luminance calculated in frame units, the amount of image correction is calculated from the results of the first infinite impulse response filtering process, and the second infinite impulse response filtering process is performed on the calculated amount of image correction (i.e., series processing). The balance between the first and second infinite impulse response filtering processes is always maintained by calculating the amount of reduction in lighting luminance and then calculating the amount of image correction depending on the amount of reduction in luminance.

(9) In the image display control device according to this embodiment, the common calculator may include a feedback path, calculation results of the common calculator being at least partially fed back to an input side of the common calculator through the feedback path.

The first and second infinite impulse response filtering processes can be performed by providing the feedback path in the common calculator.

(10) In the image display control device according to this embodiment, the plurality of codes stored in the code storage section may be microcodes obtained by converting an algorithm created using a programming language, the algorithm adaptively reducing the luminance of the image display lighting corresponding to the display image and correcting the image signal to compensate for deterioration in image quality due to the reduction in the luminance of the lighting.

For example, the code table can be efficiently created by collectively converting an algorithm created using a high-level programming language to generate microcodes, and writing the microcodes into a read only memory (ROM). The calculations performed by the common calculator can be relatively easily changed by changing the algorithm (microcodes). This makes it possible to flexibly deal with a change in design.

(11) According to another embodiment of the invention, there is provided a driver device of an electro-optical device, the driver device including one of the above image display control devices.

The image display control device (image display control LSI) according to the embodiment of the invention is mounted on a driver device (driver) of an electro-optical device (including liquid crystal display device). The image display control device (image display control LSI) according to the embodiment of the invention has a real-time capability of processing a video image such as a streaming image and allows a reduction in power consumption and size. Therefore, the added value of the driver device (driver) is increased.

(12) According to a further embodiment of the invention, there is provided a control device of an electro-optical device, the control device including one of the above image display control devices.

The image display control device (image display control LSI) according to the embodiment of the invention is mounted on a control device (controller) of an electro-optical device (including liquid crystal display device). The image display control device (image display control LSI) according to the embodiment of the invention has a real-time capability of processing a video image such as a streaming image and allows a reduction in power consumption and size. Therefore, the added value of the control device (controller) is increased.

(13) According to a further embodiment of the invention, there is provided a drive control device of an electro-optical device, the drive control device including one of the above image display control devices.

The image display control device (image display control LSI) according to the embodiment of the invention is mounted on a drive control device (device in which a driver and a controller are integrated) of an electro-optical device (including liquid crystal display device). The image display control device (image display control LSI) according to the embodiment of the invention has a real-time capability of processing a video image such as a streaming image and allows a reduction in power consumption and size. Therefore, the added value of the drive control device (device in which a driver and a controller are integrated) is increased.

(14) According to a further embodiment of the invention, there is provided an electronic instrument including one of the above image display control devices.

A streaming image distributed by one-segment broadcasting or the like can be displayed with high quality and the life of a battery can be increased by mounting the image display control device (LSI) according to the embodiment of the invention on a portable terminal (including portable telephone terminal, PDA terminal, and portable computer terminal), for example.

Adaptive luminance adjustment control corresponding to a display image and image correction performed by an image display control device (image display control LSI) according to the invention are described below with reference to FIGS. 1 to 6 before describing the embodiments of the invention.

Relationship Between Luminance Adjustment Control and Image Correction

Figure 1B:
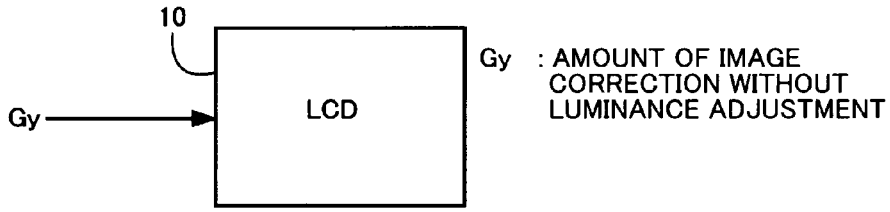
Figure 1C:
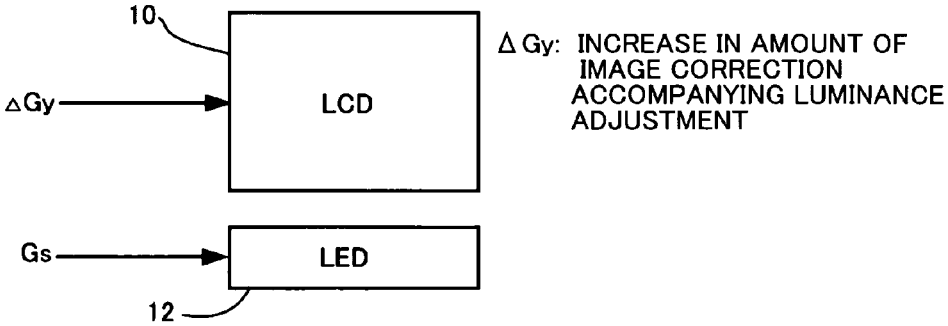

FIGS. 1A to 1C are views illustrative of adaptive luminance adjustment control corresponding to a display image and image correction employed in the image display control device (image display control LSI) according to the invention.

According to one aspect of the invention, as shown in FIG. 1A, adaptive image correction of a liquid crystal panel (LCD) 10 and adaptive correction (adaptive luminance adjustment) of the luminance of lighting (LED; hereinafter referred to as "backlight") 12 are performed at the same time. In FIG. 1A, Gy' indicates the amount of enhanced image correction with luminance adjustment. The amount of image correction Gy' is obtained by adding an increase ΔGy in the amount of image correction accompanying luminance adjustment to the amount of image correction Gy without luminance adjustment. Gs indicates the amount of luminance correction of the backlight 12 accompanying adaptive luminance adjustment.

FIG. 1B shows the amount of image correction Gy without luminance adjustment. Specifically, the amount of image correction Gy is the amount of image correction when the luminance of the backlight 12 is made constant. For example, a portion at a low luminance is corrected to increase the luminance, and a portion at an excessively high luminance is corrected to decrease the luminance.

FIG. 1C shows the increase ΔGy in the amount of image correction accompanying luminance adjustment. Since a dark image is affected to a small extent by a reduction in luminance of the backlight 12 as compared with a bright image, the amount of reduction in luminance of the backlight 12 increases as a rule when displaying a dark image. However, since the luminance of the display image decreases due to a reduction in luminance of the backlight 12, image correction is enhanced to compensate for a decrease in luminance. An increase in the amount of image correction accompanying luminance adjustment (Gs) is ΔGy.

In the invention, as shown in FIG. 1A, the luminance of the backlight 12 is positively reduced in order to reduce power consumption, and the final amount of image correction Gy' is determined by adding an increase (ΔGy) in the amount of image correction accompanying luminance adjustment (Gs) to the normal amount of image correction (Gy) in order to compensate for deterioration in image quality due to a reduction in luminance.

Amount of Image Correction Accompanying Adaptive Luminance Adjustment

Figure 2:
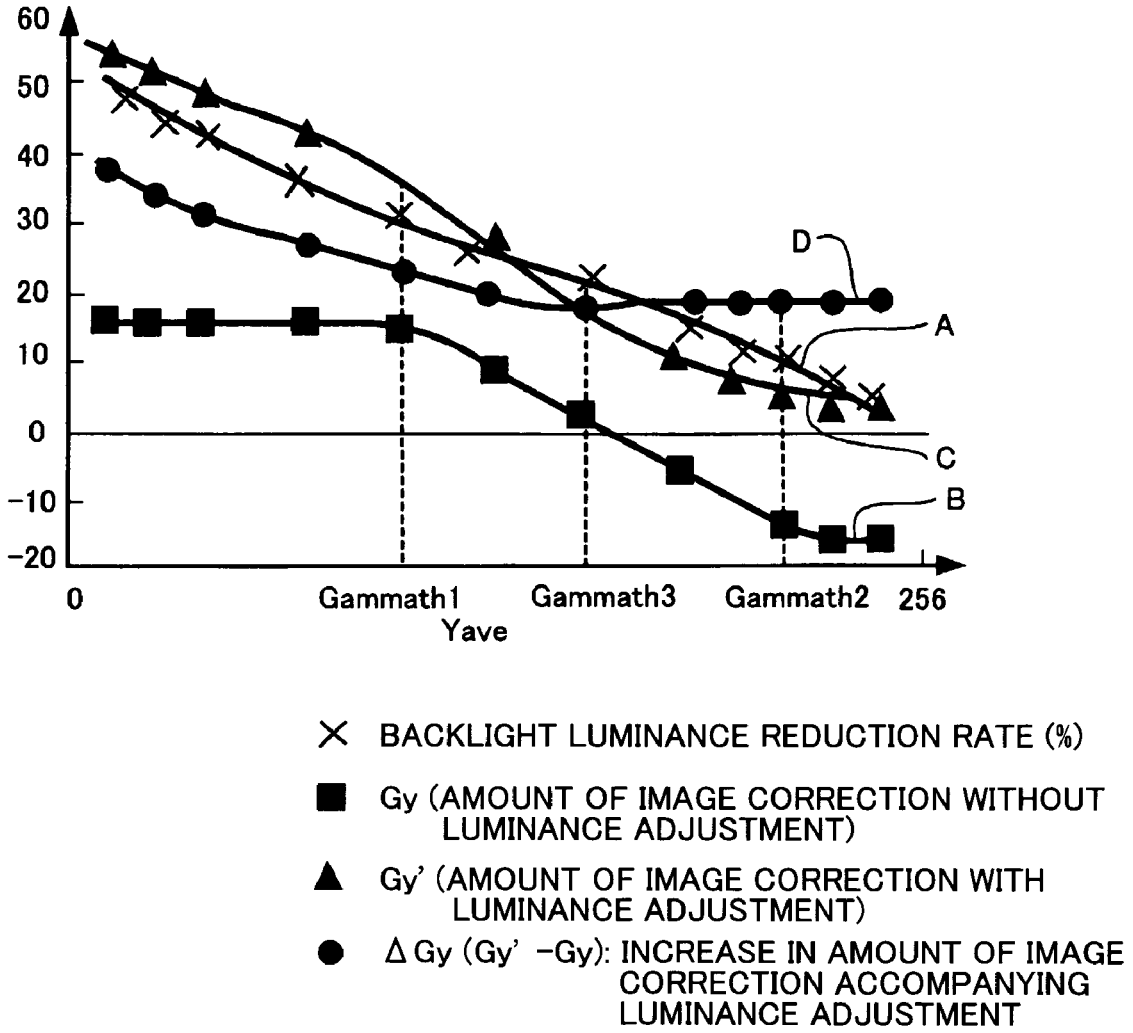
FIG. 2 is a characteristic diagram showing changes in the backlight luminance reduction rate, the amount of image correction (Gy) without luminance adjustment, the amount of image correction (Gy') with luminance adjustment, and an increase (ΔGy) in the amount of image correction accompanying luminance adjustment with respect to the average luminance (Yave) of an image of one frame.

FIG. 2 is a characteristic diagram showing changes in the backlight luminance reduction rate, the amount of image correction (Gy) without luminance adjustment, the amount of image correction (Gy') with luminance adjustment, and an increase (ΔGy) in the amount of image correction accompanying luminance adjustment with respect to the average luminance (Yave) of an image of one frame.

In FIG. 2, a characteristic line A indicates the characteristics of the backlight luminance reduction rate (%), a characteristic line B indicates the characteristics of the amount of image correction (Gy) without luminance adjustment, a characteristic line C indicates the characteristics of the amount of image correction (Gy') with luminance adjustment, and a characteristic line D indicates the characteristics of the increase (ΔGy) in the amount of image correction accompanying luminance adjustment.

The characteristic line A which indicates a change in the backlight luminance reduction rate is analyzed below. As shown in FIG. 2, the backlight luminance reduction rate increases as the average luminance (Yave) decreases, and decreases as the average luminance (Yave) increases. Specifically, since an image with a higher average luminance is affected to a larger extent by a reduction in luminance of the backlight, the luminance of the backlight is reduced to a large extent when the image has a low average luminance as a result of giving priority to a reduction in power consumption, and the luminance of the backlight is reduced to a small extent when the image has a high average luminance as a result of giving priority to suppressing deterioration in image quality.

The characteristic line B which indicates a change in the amount of image correction (Gy) without luminance adjustment is analyzed below. As shown in FIG. 2, an almost constant amount of luminance increase correction is made when the average luminance is equal to or smaller than Gammath1. The amount of increase in luminance decreases as the average luminance increases. When the average luminance exceeds Gammath2, correction is made which decreases the luminance. Specifically, correction which increases the luminance is basically made when the average luminance is low, and correction which decreases the luminance is basically made when the average luminance is too high.

The characteristic line C which indicates a change in the amount of image correction (Gy') with luminance adjustment is analyzed below. As shown in FIG. 2, the amount of image correction increases as the average luminance decreases, and decreases as the average luminance increases. This is because the amount of image correction is determined based on the characteristic line B, and the amount of image correction must be increased when the average luminance is low in order to prevent deterioration in image quality at a low luminance at which the luminance reduction rate is set at a large value.

The characteristic line D which indicates a change in an increase (ΔGy=Gy'−Gy) in the amount of image correction accompanying luminance adjustment is analyzed below. An increase ΔGy in the amount of image correction accompanying luminance adjustment increases as the luminance decreases, and gradually decreases as the luminance increases, as described above. An increase in the amount of image correction gradually increases when the average luminance exceeds about Gammath3. Specifically, since the image quality of an image with a higher luminance may be likely to deteriorate due to a reduction in luminance of the backlight 12, image correction must be enhanced in order to suppress a decrease in luminance of an image with a high average luminance.

Relationship Between Reduction in Power Consumption and ΔGy

Figure 3:
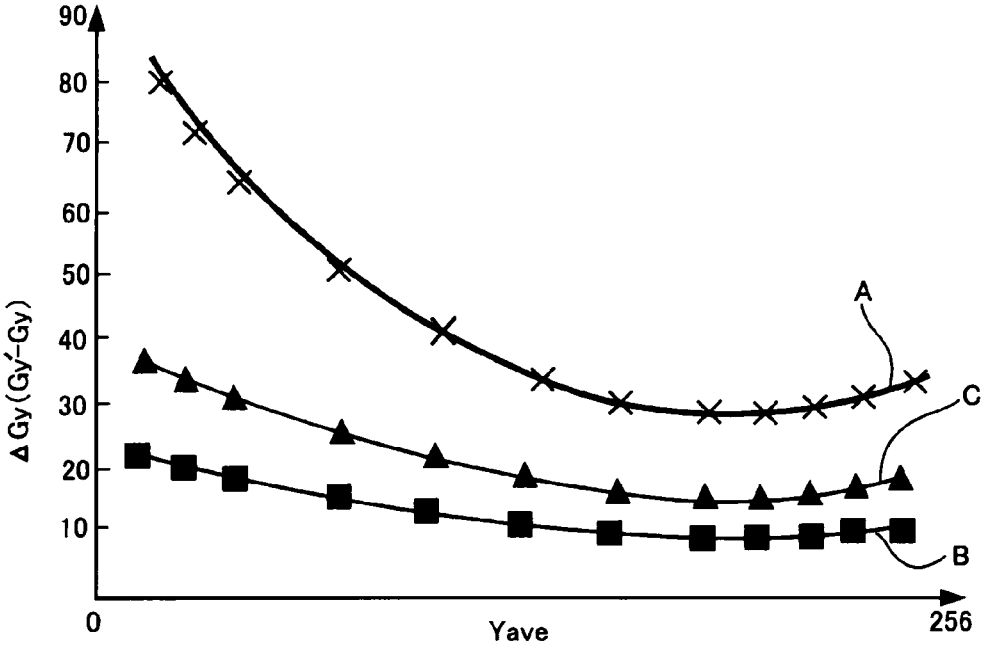
FIG. 3 is a view showing a state in which a characteristic line of an increase (ΔGy=Gy'−Gy) in the amount of image correction accompanying luminance adjustment changes depending on the backlight luminance reduction rate.

FIG. 3 is a view showing a state in which the characteristic line of an increase (ΔGy=Gy'−Gy) in the amount of image correction accompanying luminance adjustment changes depending on the backlight luminance reduction rate. In FIG. 3, a characteristic line A indicates the case where power consumption is reduced to a large extent (backlight luminance reduction rate: 30%), a characteristic line B indicates the case where power consumption is reduced to a small extent (backlight luminance reduction rate: 10%), and a characteristic line C indicates the case where a reduction in power consumption is normal (backlight luminance reduction rate: 20%).

As described above, each characteristic line shows a tendency in which an increase ΔGy in the amount of image correction accompanying luminance adjustment increases as the luminance decreases, gradually decreases as the luminance increases, and again increases gradually as the luminance increases. An increase ΔGy in the amount of image correction accompanying luminance adjustment increases as the backlight luminance reduction rate is increased to reduce power consumption.

Enhancement of Chroma Correction

The chroma of the entire screen decreases due to a reduction in luminance of the backlight. Therefore, chroma correction is performed so that the chroma remains the same before and after luminance adjustment. Chroma correction is basically performed according to the following equation (1). The following equation defines the blue chroma (Cb=Y−B). Note that the same equation applies to the red chroma (Cr=Y−R).

$$Cb[cb]=Fc\times Gc+Cb \quad (1)$$

where, cb indicates a chroma correction input color difference, Cb indicates a chroma correction output color difference, Gc indicates the amount of chroma correction, and Fc indicates a chroma correction coefficient curve.

Figure 4A:
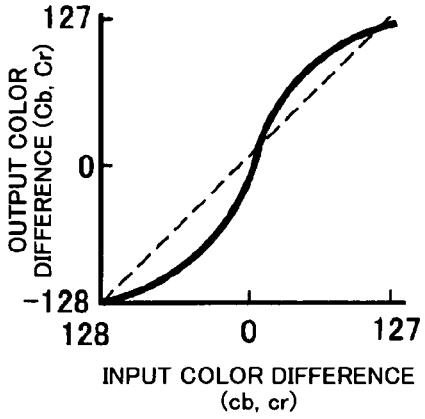
FIGS. 4A to 4C are views illustrative of chroma correction.
Figure 4B:
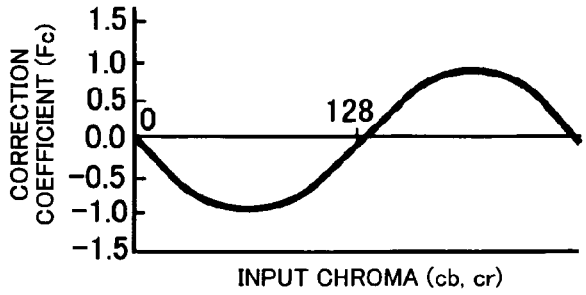
Figure 4C:
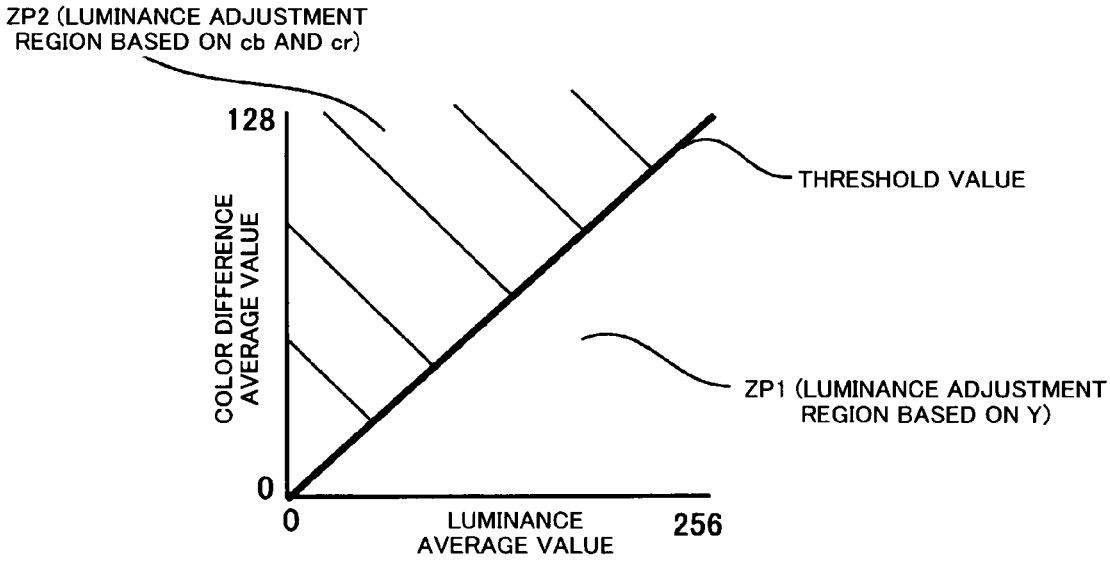

FIGS. 4A to 4C are views illustrative of chroma correction. FIG. 4A shows the output color difference (Cb or Cr) with respect to the input color difference (cb or cr). In FIG. 4A, the difference between a characteristic line indicated by a solid line and a straight line indicated by a dotted line corresponds to the amount of chroma correction Gc in the equation (1). FIG. 4B shows the characteristics of a correction coefficient (Fc) with respect to the input chroma (cb or cr). Since the equation (1) shows chroma correction when luminance adjustment is not taken into consideration, an increase ΔGc in the amount of chroma correction accompanying luminance adjustment must be added to the amount of chroma correction Gc. An increase ΔGc in the amount of chroma correction may be determined by solving an equation under conditions where the average chroma is made equal before and after luminance adjustment.

When the amount of reduction in luminance is determined merely based on the luminance of the image, the brightness (vividness) of red (R) and blue (B) may be impaired due to too large a reduction in luminance. Specifically, since a dark image is affected by a reduction in luminance to a small extent, the luminance is reduced to a large extent. On the other hand, when a large and bright rose or the like is displayed at the center of a dark image, the amount of reduction in luminance is appropriately limited in order to suppress a decrease in chroma of the rose. However, since red (R) and blue (B) contribute to the luminance (Y) to a small extent, the luminance may be reduced to a large extent when the amount of reduction in luminance is determined merely based on the luminance (Y) (i.e., the image is determined to be a dark image). In order to prevent such an excessive reduction in luminance, the amount of reduction in luminance is determined based on the luminance (Y) and the chroma (red chroma (Cr) and blue chroma (Cb)). When the luminance and the chroma satisfy a specific relationship, the amount of reduction in luminance is limited as a result of giving priority to the chroma. This suppresses a reduction in luminance when the image has a high chroma, whereby a decrease in chroma of the display image is suppressed.

FIG. 4C is a view illustrative of a process of determining whether to give priority to either a reduction in luminance or the chroma using a threshold value determined based on the relationship between the average luminance and the average chroma. As shown in FIG. 4C, a threshold value is set which is determined based on the relationship between the average luminance and the average color difference (i.e., chroma), and whether to reduce the luminance based on either the luminance or the chroma is determined based on the threshold value as a boundary.

In FIG. 4C, a region ZP2 indicated by diagonal lines is a luminance adjustment region based on the chroma (cr, cb), and a region ZP1 is a luminance adjustment region based on the luminance (Y). For example, when the average luminance is 64 (i.e., dark image), the amount of reduction in luminance increases to a considerable extent when determined merely based on the luminance. However, when the average chroma is 96 (i.e., the image has a high chroma), it is necessary to suppress a decrease in chroma due to a reduction in luminance. Therefore, the amount of reduction in luminance is determined based on the chroma (i.e., the amount of reduction in luminance is reduced as compared with the case of determining the amount of reduction in luminance based on the luminance). Specifically, the amount of reduction in luminance based on the luminance is limited based on the chroma to suppress an excessive reduction in luminance which extremely decreases the chroma.

Filtering Process which Prevents Flicker Accompanying Scene Change

When adaptive lighting luminance adjustment and image correction are performed in each frame of a video image, a visual flicker occurs due to sudden changes in lighting luminance and the amount of image correction accompanying a scene change. Therefore, luminance correction and image correction calculated in frame units are appropriately filtered depending on their characteristics. Specifically, since a change in lighting luminance is a change in black and white and is easily observed visually, a filtering process with a large time constant is performed. On the other hand, since a change in the amount of image correction is a change in halftone and is observed with difficulty, a filtering process with a small time constant is performed taking a quick response to a scene change in a video image into consideration. This makes it possible to effectively suppress a flicker accompanying adaptive luminance correction while achieving image correction following a scene change in a video image.

When independently performing each filtering process, the balance between luminance correction and image correction may be impaired, whereby the image quality may deteriorate. Therefore, a first filtering process is performed on the lighting luminance calculated in frame units, the amount of image correction is calculated from the results of the first filtering process, and a second filtering process is performed on the calculated amount of image correction (i.e., configuration of performing series processing). The balance between the first and second filtering processes is always maintained by calculating the amount of reduction in lighting luminance and then calculating the amount of image correction depending on the amount of reduction in luminance.

Figure 5A:
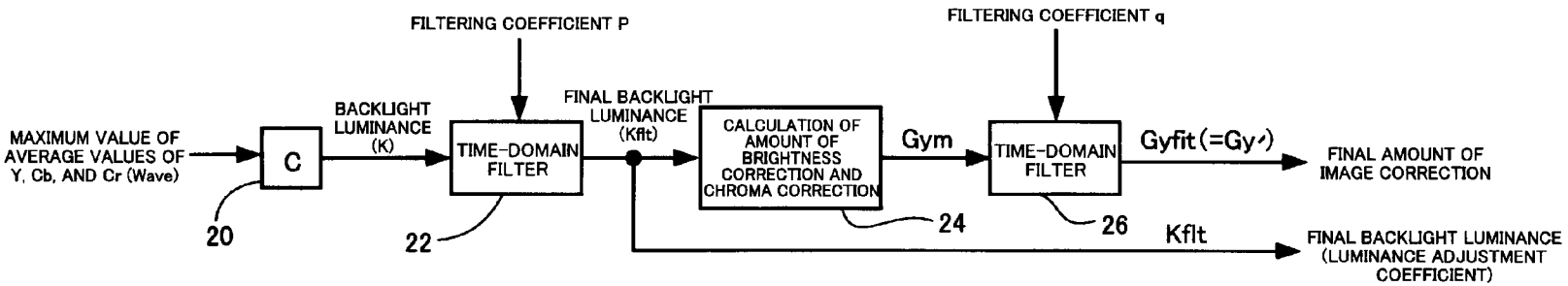
FIGS. 5A to 5D are views illustrative of an outline of an image display control device according to the invention and a filtering process.
Figure 5B:
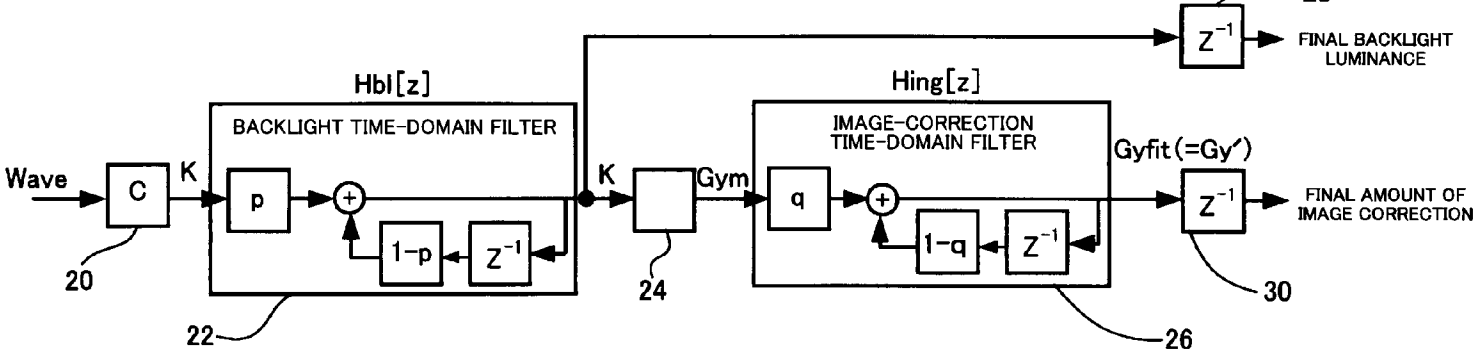
Figure 5C:
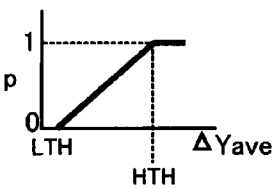
Figure 5D:
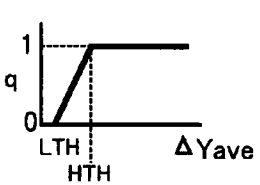

FIGS. 5A to 5D are views illustrative of an outline of the image display control device according to the invention and the filtering process. FIG. 5A is a block diagram showing the entire configuration of the image display control device. FIG. 5B is a block diagram showing the configuration shown in FIG. 5A in more detail. FIG. 5C is a view showing the time constant of the filtering process performed during luminance adjustment control. FIG. 5D is a view showing the time constant of the filtering process performed during image correction.

As shown in FIG. 5A, the maximum value (Wave) of the average values of the luminance (Y), the blue chroma (Cb), and the red chroma (Cr) is input. The input signal is subjected to a linear process (C) to calculate the backlight luminance (K). The backlight luminance (K) is filtered using a time-domain filter 22 with a large time constant to obtain the final backlight luminance (luminance adjustment coefficient indicating the backlight luminance after reduction in luminance) Kflt. The characteristics of the time-domain filter 22 are controlled based on a filtering coefficient P. FIG. 5C shows the relationship between the filtering coefficient P and an average luminance change rate (ΔYave) of an image.

An image correction amount calculation section 24 calculates the amount of correction Gm of luminance correction and chroma correction based on the final backlight luminance (Kflt). The amount of image correction Gym is filtered using a time-domain filter 26 with a small time constant, whereby the final amount of image correction (Gy') is calculated. The characteristics of the time-domain filter 26 are controlled based on a filtering coefficient q. FIG. 5D shows the relationship between the filtering coefficient q and the average luminance change rate (ΔYave) of an image.

As shown in FIG. 5B, the backlight time-domain filter 22 is an infinite impulse response (IIR) filter, and the image-correction time-domain filter 26 is also an infinite impulse response (IIR) filter. The transfer function of the backlight time-domain filter 22 is Hbl[z], and the transfer function of the image-correction time-domain filter 26 is Himg[Z]. Therefore, the transfer function of the filtering process of the image display control device is indicated by Hbl[z]·Himg[Z]. The image correction amount calculation section 24 is implemented by a nonlinear transfer function. In FIG. 5B, reference numerals 28 and 30 indicate delay elements.

The embodiments of the invention are described below with reference to the drawings.

First Embodiment

Mounting of Image Display Control Device

FIGS. 6A to 6D are block diagrams illustrative of mounting of the image display device according to the invention.

Figure 6A:
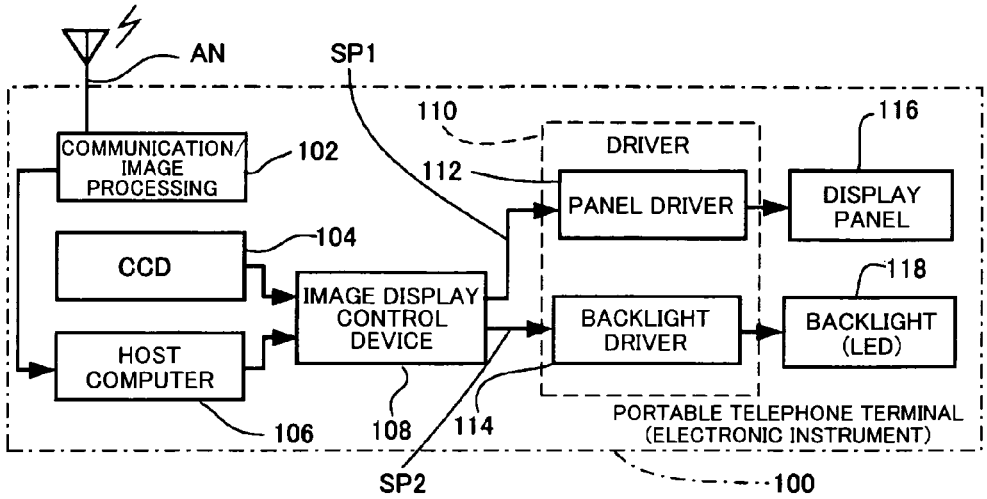
FIGS. 6A to 6D are block diagrams illustrative of mounting of an image display device according to the invention.

In FIG. 6A, the image display control device (image display control LSI) is mounted on a portable telephone terminal (example of electronic instrument) 100. The portable telephone terminal 100 includes an antenna AN, a communication/image processing section 102, a CCD camera 104, a host computer 106, an image display control device (image display control LSI) 108, a driver 110 (including a panel driver 112 and a backlight driver 114), a display panel (e.g., liquid crystal panel (LCD)) 116, and a backlight (LED) 118.

Figure 6B:
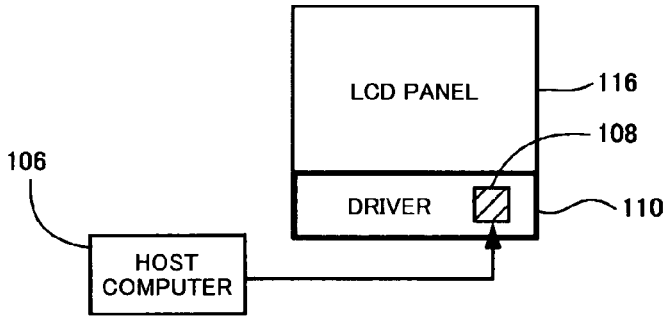

In FIG. 6B, the image display control device (image display control LSI) 108 is mounted on a driver device (driver) 110. An image signal and control information are input to the image display control device (image display control LSI) 108 from the host computer 106.

Figure 6C:
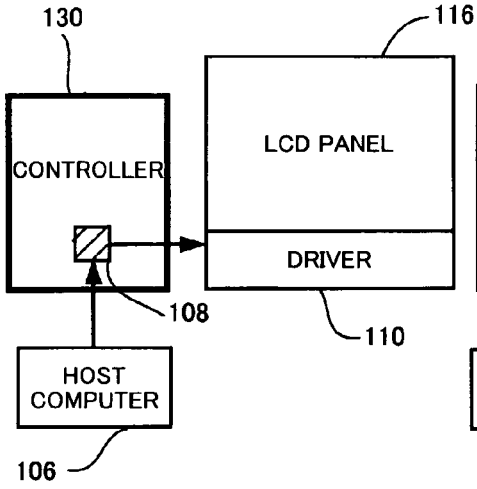
Figure 6D:
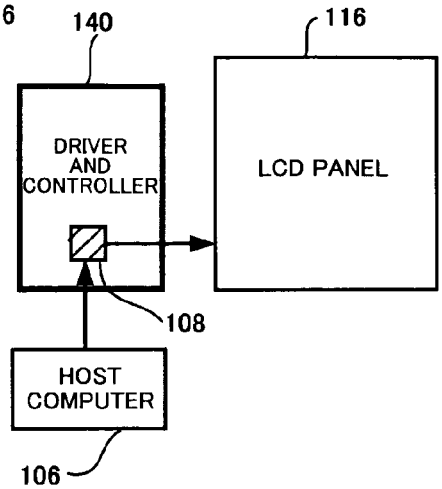

In FIG. 6C, the image display control device (image display control LSI) 108 is mounted on a control device (controller) 130 of the driver 110. In FIG. 6D, the image display control device (image display control LSI) 108 is mounted on a drive control device (device in which a driver and a controller are integrated) 140.

The image display control device (image display control LSI) 108 according to the invention has a real-time capability of processing a video image such as a streaming image and allows a reduction in power consumption and size. Therefore, the added values of the driver device (driver) 110, the control device (controller) 130, the drive control device (device in which a driver and a controller are integrated), and an electronic instrument 100 are increased by mounting the image display control device (image display control LSI) according to the invention.

Entire Configuration of Image Display Control Device

Figure 7:
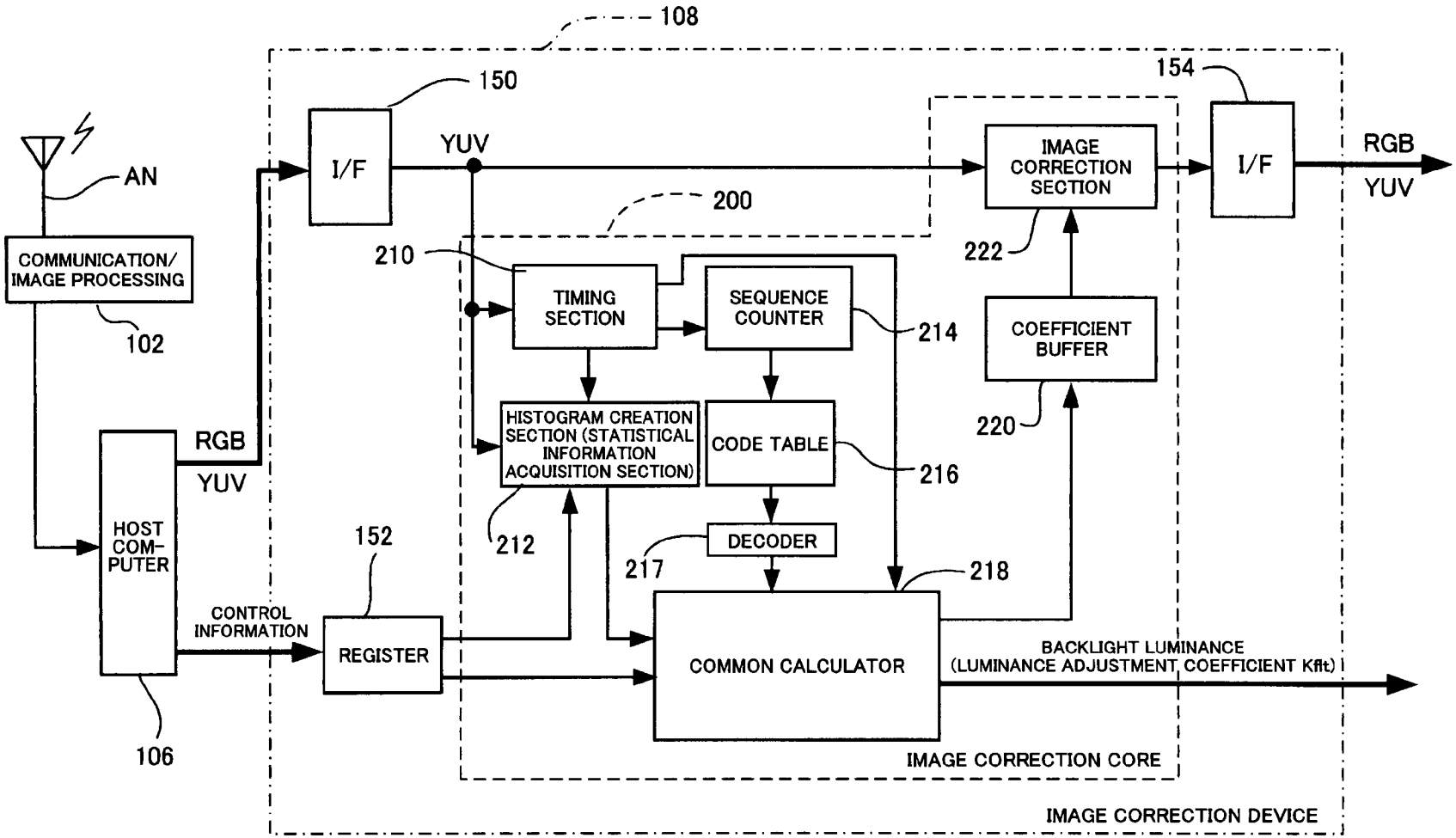
FIG. 7 is a block diagram showing an outline of the entire configuration of an image display control device (image display control LSI) according to the invention.

FIG. 7 is a block diagram showing an outline of the entire configuration of an image display control device (image display control LSI) according to the invention.

The following description is given on the assumption that the image display control device 108 is mounted on a portable terminal (including portable telephone terminal, PDA terminal, and portable computer terminal). The portable terminal includes the antenna AN which receives one-segment broadcasting, the communication/image processing section 102, and the host computer 106, for example. The host computer 102 supplies the received streaming image signal to the image display control device 108, for example. An image signal captured using a CCD camera may also be supplied to the image display control device 108 (see FIG. 6A). In FIG. 7, the CCD camera is omitted.

As shown in FIG. 7, the image display control device 108 includes an image input interface (I/F) 150 which receives an image signal (RGB (color signal format) or YUV (luminance signal/color difference signal format)) supplied from the host computer 106, and converts the RGB image signal into a YUV image signal, a register 152 which temporarily stores control information 152 supplied from the host computer 106, an image correction core 200 which determines the backlight luminance (luminance adjustment coefficient Kflt) after luminance adjustment and performs an image correction process on the image signal to compensate for deterioration in image quality due to a reduction in luminance, and an image output interface (I/F) 154 which converts the YUV image signal into an RGB image signal or directly outputs the YUV image signal.

The image correction core 200 includes a timing section 210 which extracts a synchronization signal from the YUV image signal output from the image input interface (I/F) 150, and generates a timing signal which indicates the operation timing of each section, a histogram creation section (statistical information acquisition section) 212 which acquires statistical information necessary for calculations, a sequence counter 214, a code table 216 which stores microcodes into which a correction algorithm is subdivided, a decoder 217 which decodes the microcodes to generate an instruction and data, a common calculator 218 which includes minimum circuits and is used in common for a luminance adjustment process and an image correction process, a coefficient buffer 220 which temporarily stores an image correction coefficient generated by calculations, and an image correction section 222 which corrects the image signal using the correction coefficient.

Figure 8:
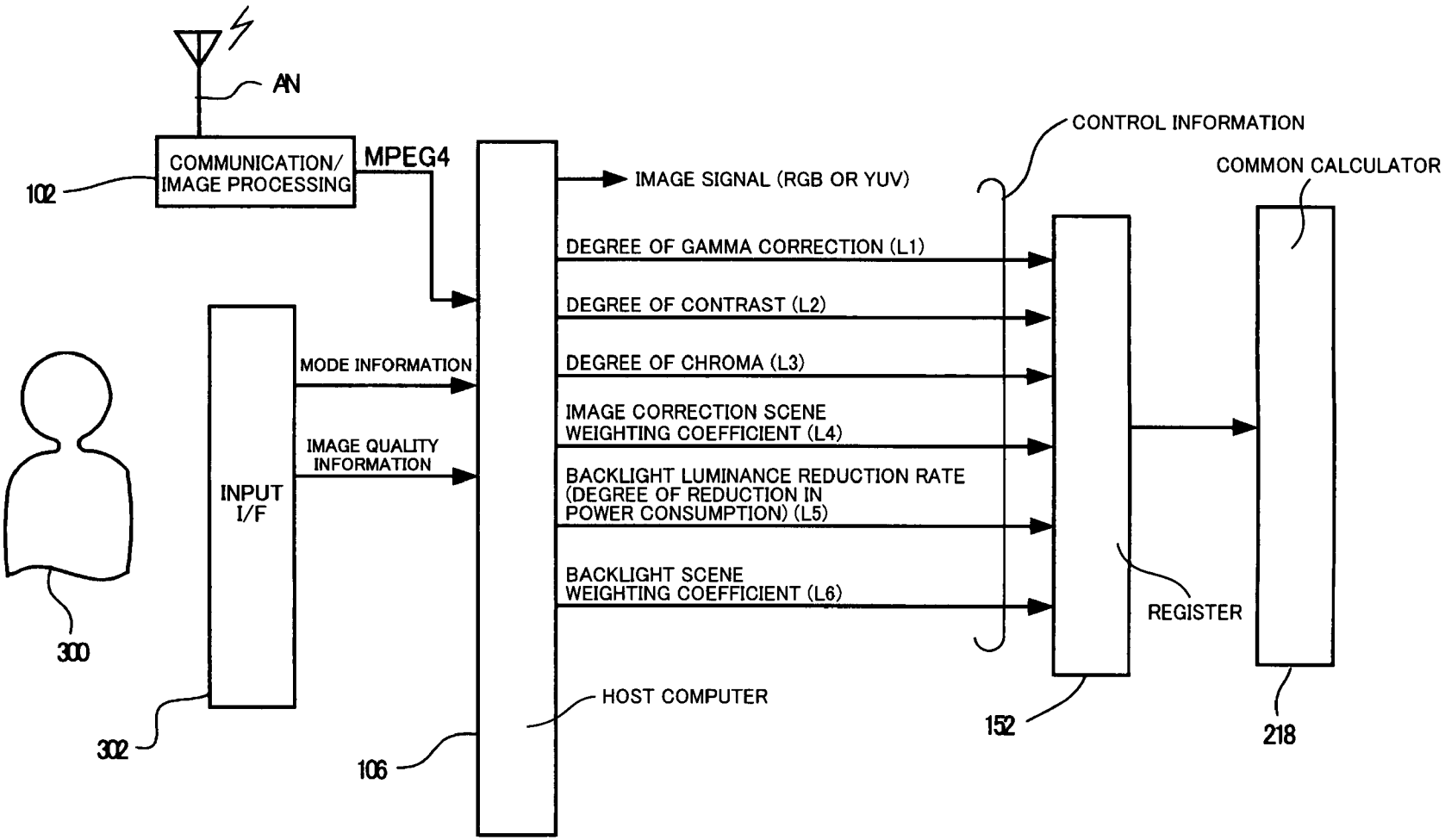
FIG. 8 is a view showing a control signal supplied from a host computer to an image display control device.

FIG. 8 is a view showing a control signal supplied from a host computer to an image display control device. An image signal conforming to the MPEG-4 standard or the like is input to the host computer 106 from the communication/image processing section 102. Mode information (e.g., mode signal which specifies a high-definition display mode) and image quality information (e.g., information indicating the degree of gamma correction, contrast, and chroma and scene weighting coefficient information) are also input to the host computer 106 from an image input interface (I/F) 302.

The host computer 106 outputs an image signal (RGB format or YUV format). The host computer 106 also outputs the control information including a degree of gamma correction (L1), a degree of contrast (L2), a degree of chroma (L3), an image correction scene weighting coefficient (L4), a backlight luminance reduction rate (degree of reduction in power consumption: L5), and a backlight scene weighting coefficient (L6). The image correction scene weighting coefficient (L4) and the backlight scene weighting coefficient (L6) respectively correspond to the filtering coefficients P and Q shown in FIG. 5.

The control information is temporarily stored in the register 152, and supplied to the common calculator 218. The common calculator 218 performs specific calculations using the instruction and data from the decoder 217 based on the supplied control information, and generates the image correction coefficient and the backlight luminance (luminance adjustment coefficient Kflt).

Figure 9:
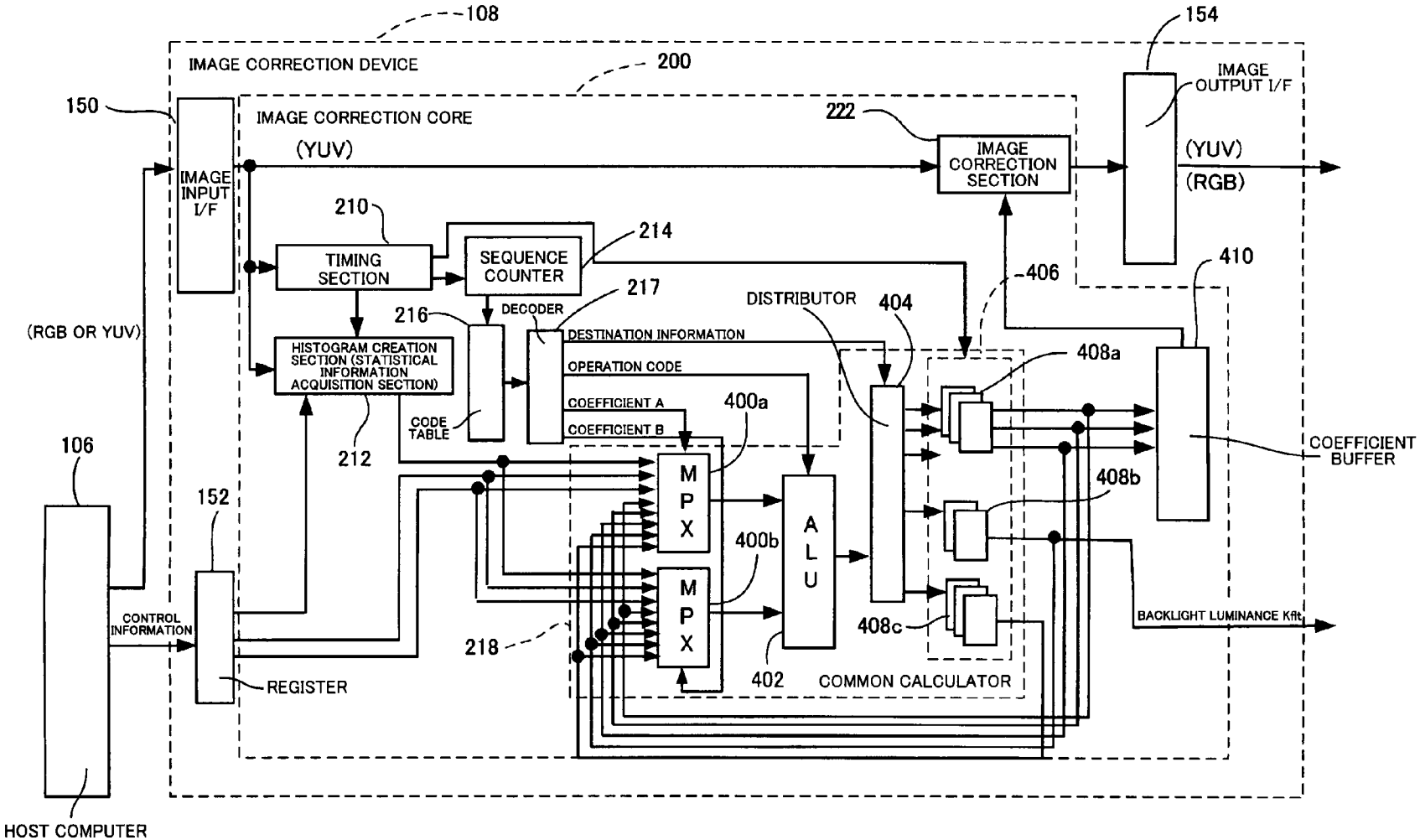
FIG. 9 is a block diagram showing a specific configuration of the image display control device shown in FIG. 7.

FIG. 9 is a block diagram showing a specific configuration of the image display control device shown in FIG. 7. FIG. 9 shows the configuration of the image correction core 200 in detail. In FIG. 9, the same sections as in FIG. 7 are indicated by the same reference numerals.

In FIG. 9, the common calculator 218 includes first and second multiplexers (400*a* and 400*b*), an arithmetic logic unit (ALU) 402, a distributor 404 which distributes the calculation results of the arithmetic logic unit (ALU), and a plurality of output destination registers (destination registers) 406. The output destination registers 406 include register groups 408*a* to 408*c* classified in output destination units. A feedback path is formed through which the calculation results stored in the register groups 408*a* to 408*c* are at least partially fed back to the input side of the first and second multiplexers (400*a* and 400*b*).

The function and the operation of each section of the image correction core 200 shown in FIG. 9 are described below in detail.

The histogram creation section (statistical information acquisition section) 212 acquires statistical information (i.e., statistical information relating to luminance and statistical information relating to chroma) of an image signal of one frame. A specific internal configuration of the histogram creation section (statistical information acquisition section) 212 is described later in a third embodiment.

The code table (code storage section) 216 stores a plurality of microcodes which specify the operation procedure of the common calculator 218. A procedure of creating the code table 216 is described later in a second embodiment.

The sequence counter (sequence instruction section) 214 specifies the code table 216, and controls the order of output of the microcodes from the code table 216. The decoder 217 decodes the microcodes sequentially output from the code table 216, and generates at least one of an instruction and data (e.g., coefficient) supplied to the common calculator.

The decoder 217 supplies the coefficient used for calculations to the first and second multiplexers (400*a* and 400*b*), supplies an operation instruction (operation code) to the arithmetic logic unit (ALU) 402, and supplies destination information to the distributor 404.

The common calculator 218 calculates the image correction coefficient and the backlight luminance (luminance adjustment coefficient Kfit) after reduction in luminance in real time. The digital signal processing described with reference to FIGS. 5A to 5D is performed by the calculations performed by the common calculator 218. Moreover, the chroma enhancement process, the process of limiting the backlight luminance reduction rate in order to prevent deterioration in image quality of a high-chroma image, and the process of serially performing the first and second infinite impulse response filtering processes described with reference to FIGS. 2 to 5 are substantially performed.

The calculations performed by the common calculator 218 are controlled by the microcodes which specify the signal processing procedure, as described above. Real-time calculations can be performed without parallelly providing the same type of hardware by utilizing a common calculator having a minimum circuit configuration. Therefore, high-speed luminance adjustment control and image correction can be implemented using a minimum number of circuits and with minimum power consumption.

The calculation results of the common calculator 218 are temporarily stored in the register groups 408*a* to 408*c* classified in output destination units. The calculated backlight luminance (luminance adjustment coefficient Kflt) is output to a backlight (LED) driver, and the correction coefficient is stored in the coefficient buffer 410. The correction coefficient stored in the coefficient buffer 410 is supplied to the image correction section 222 in synchronization with the input of an image signal of the next frame, and image correction (enhancement of luminance and chroma) is performed.

The calculation results stored in the register groups 408*a* to 408*c* are at least partially fed back to the input side of the first and second multiplexers (400*a* and 400*b*) through the feedback path. The process of calculating the lighting luminance after reduction in luminance, feeding back the calculation results to the input side, and calculating the image correction coefficient based on the calculated luminance is thus performed. The first and second infinite impulse response (IIR) filtering processes are also performed.

Second Embodiment

Figure 10:
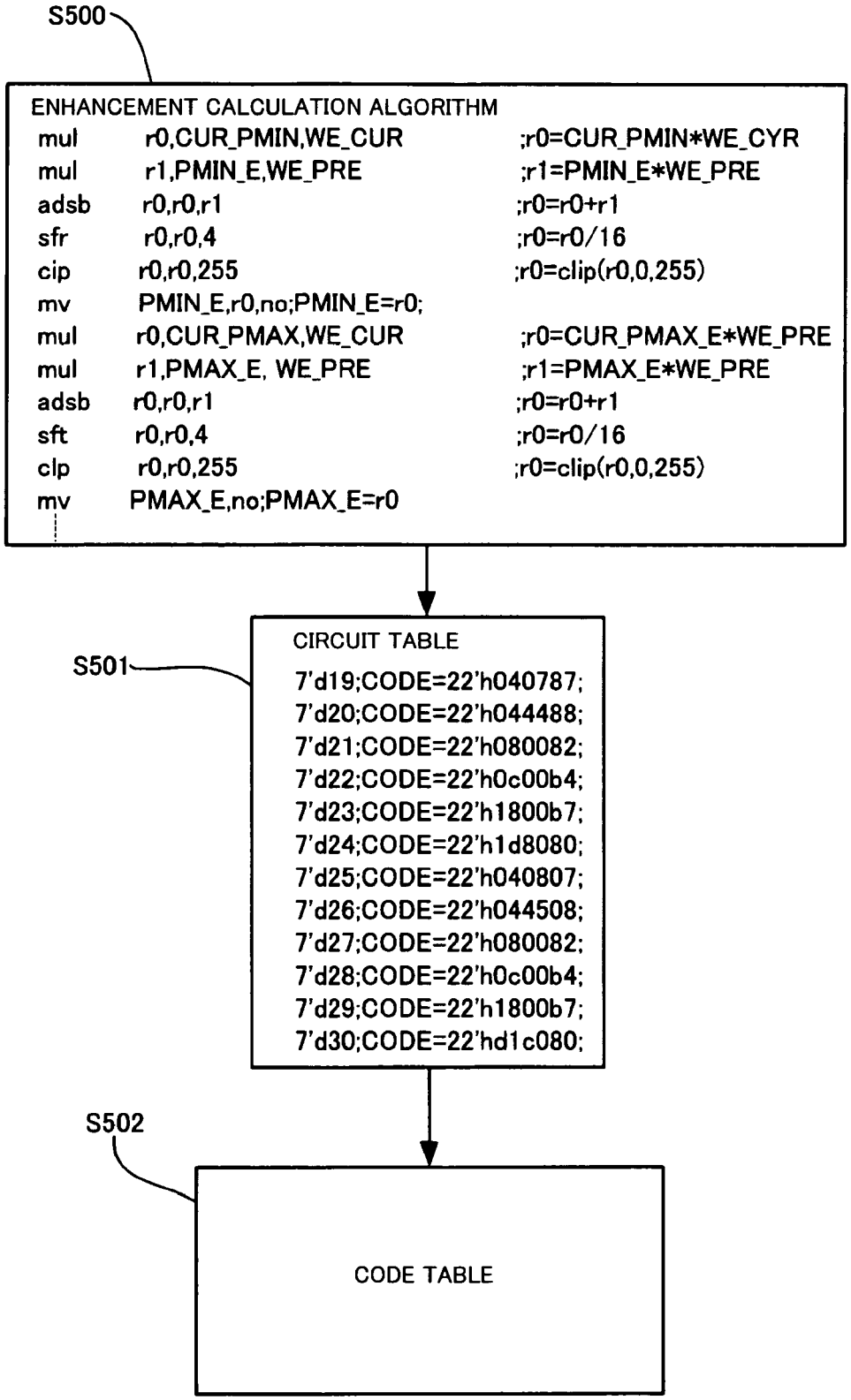
FIG. 10 is a view showing a procedure of creating a code table.

This embodiment illustrates a procedure of creating the code table shown in FIG. 9. FIG. 10 is a view showing a procedure of creating the code table.

In FIG. 10, an algorithm (enhancement calculation algorithm) using a programming language (e.g., high-level programming language) for adaptively reducing the luminance of the image display backlight corresponding to the display image and correcting the image signal to compensate for deterioration in image quality due to a reduction in backlight luminance is provided (step S500).

The algorithm created using the programming language is collectively converted to generate microcodes (step S502).

The generated microcodes are written into a read only memory (ROM) (step S502).

The code table 216 can be efficiently created in this manner. Moreover, the calculations of the common calculator 218 can be relatively easily changed by changing the algorithm (microcodes). This makes it possible to flexibly deal with a change in design.

Third Embodiment

This embodiment illustrates a specific internal configuration of the histogram creation section (statistical information acquisition section) 212 shown in FIG. 9.

As described above, the image display control device according to the invention acquires the statistical values relating to the luminance and the chroma of the image signal of one frame, and adaptively corrects the backlight luminance and the image signal (chroma and luminance) based on the statistical values. When the image has a low average luminance but has a high average chroma, the image display control device limits the backlight luminance reduction rate when correcting the image as a result of giving priority to the chroma over a reduction in power consumption. In order to perform such control, it is necessary to quickly acquire the necessary statistical value information relating to the luminance and the chroma.

Figure 11:
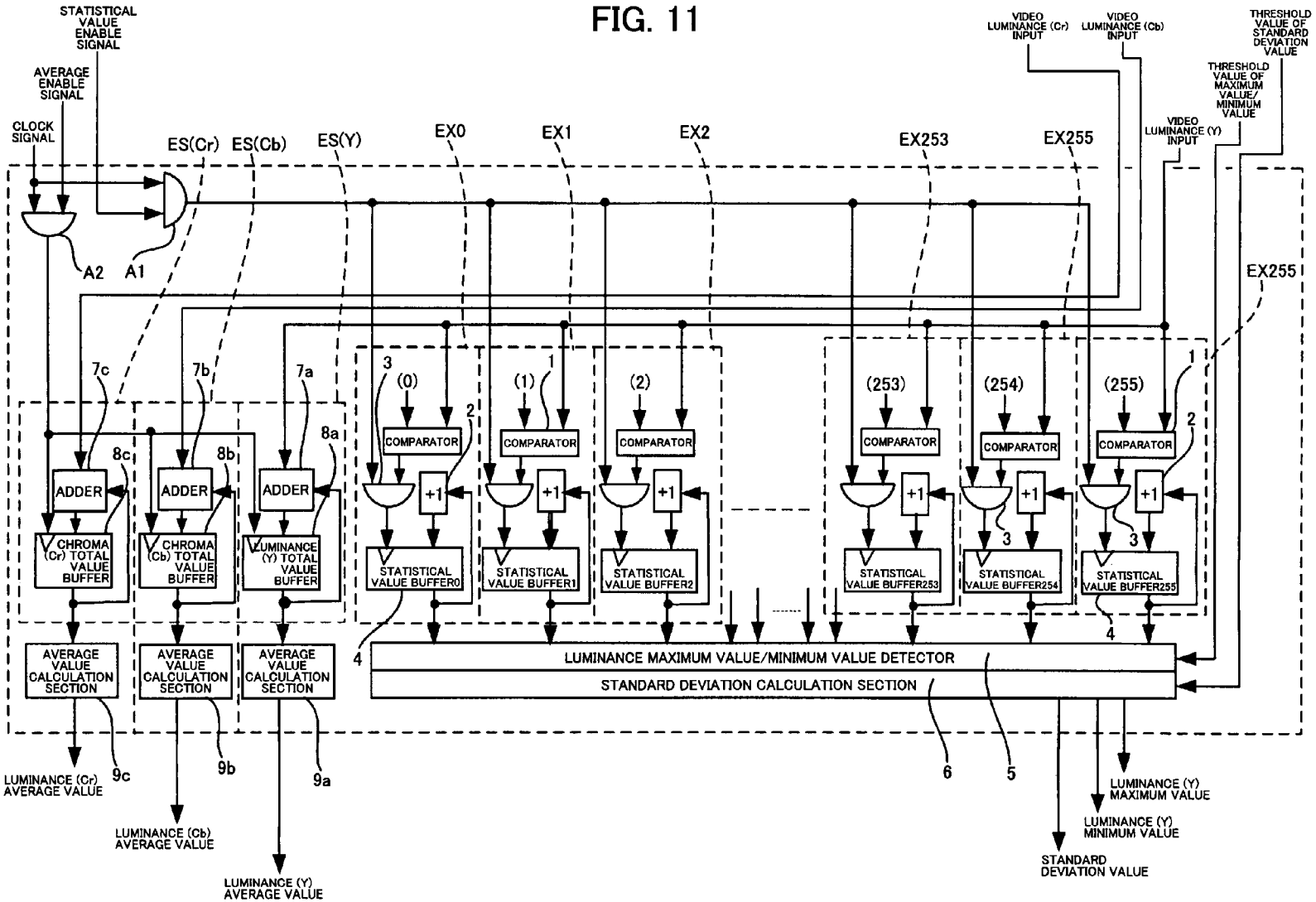
FIG. 11 is a circuit diagram showing a specific internal configuration of a histogram creation section (statistical information acquisition section) shown in FIG. 9.

FIG. 11 is a circuit diagram showing a specific internal configuration of a histogram creation section (statistical information acquisition section) shown in FIG. 9. As shown in FIG. 11, the histogram creation section includes luminance histogram creation statistical units (EX0 to EX255). The statistical units EX0 to EX255 have an identical circuit configuration. Specifically, each of the luminance histogram creation statistical units (EX0 to EX255) includes a comparator 1 which compares the luminance of the input image signal with a reference luminance (the reference luminance differs depending on the statistical unit), an up-counter 2, an AND gate 3, and a statistical value buffer 4. The luminance is expressed by 256 grayscales. The reference luminances (1) to (255) corresponding to the respective grayscales are respectively supplied to the comparators (EX0 to EX255).

The luminance signal (Y) of the image signal is parallelly input to the statistical units (EX0 to EX255), and is simultaneously compared by the comparators 1 with the reference luminances (1) to (255) corresponding to the respective grayscales. Each comparator 1 functions as a luminance coincidence detection circuit. The output of the comparator is set at a high level when the input luminance coincides with the reference luminance, whereby an operation clock signal supplied to the other input terminal of the AND gate 3 is supplied to the statistical value buffer 4.

The statistical value buffer 4 acquires and latches the count value of the up-counter 2 at a timing at which the clock signal is supplied. The luminance of each pixel contained in the image signal is thus classified and counted in grayscale units. Since the luminance of the input image is parallelly input to each statistical unit, the statistical values can be acquired at high speed.

A luminance maximum value/minimum value detector 5 calculates the maximum value and the minimum value of the luminance (Y) based on the count value of each statistical unit (EX0 to EX255). A standard deviation calculation section 6 calculates a standard deviation value which indicates the distribution of the luminance (Y). Adaptive luminance adjustment and image correction are performed using the statistical values thus calculated.

As shown in FIG. 11 (lower side), the histogram creation section includes a statistical unit ES(Y) which calculates the average value of the luminance (Y), a statistical unit ES(Cb) which calculates the average value of the blue chroma (Cb), and a statistical unit ES(Cr) which calculates the average value of the red chroma (Cr). Each statistical unit (ES(Y), ES(Cb), and ES(Cr)) has an identical configuration.

Specifically, each statistical unit (ES(Y), ES(Cb), and ES(Cr)) includes an adder (7*a* to 7*c*) which accumulates the Y, Cb, or Cr values, and a total value buffer (8*a* to 8*c*) which stores the accumulated value. Average value calculation sections (9*a* to 9*c*) respectively calculate and output the average value of the luminance (Y), the average value of the chroma (Cb), and the average value of the chroma (Cr).

As described with reference to FIG. 4C, whether the luminance (Y) or the chroma (Cb and Cr) is used to calculate the luminance adjustment coefficient is selected based on the relationship between the luminance (Y) and the chroma (Cb and Cr). The average value of the luminance (Y), the average value of the chroma (Cb), and the average value of the chroma (Cr) are used for such a determination.

An AND gate A1 shown at the lower left in FIG. 11 is provided to gate the operation clock signal supplied to each statistical unit (EX0 to EX255) using a statistical value enable signal to suspend the supply of the clock signal, if necessary. Likewise, an AND gate A2 is provided to gate the operation clock signal supplied to each statistical unit (ES(Y), ES(Cb), and ES(Cr)) using an average enable signal to suspend the supply of the clock signal, if necessary. Power consumption can be reduced by suspending the supply of the clock signal to suspend the statistical value acquisition operation when it is unnecessary to acquire the statistical value.

The invention has been described above based on the embodiments. Note that the invention is not limited to the above embodiments. Various modifications, variations, and applications may be made without departing from the spirit and scope of the invention.

According to at least one aspect of the invention, the following effects can be obtained, for example.

(1) Real-time calculations can be implemented without parallelly providing the same type of hardware by utilizing a microprogram-controlled common calculator, whereby high-speed adaptive luminance adjustment control and adaptive image correction can be implemented using a minimum number of circuits and with minimum power consumption.

(2) A decrease in chroma can be suppressed by enhancing not only the luminance but also the chroma, thereby making it possible to more effectively compensate for deterioration in image quality due to a reduction in luminance.

(3) The amount of reduction in luminance is limited when the image has a high chroma by determining the amount of reduction in luminance taking the luminance and the chroma into consideration. This makes it possible to effectively prevent a decrease in chroma due to an excessive reduction in luminance.

(4) A flicker (visual flicker) can be effectively suppressed while ensuring a quick response to a scene change of a video image by performing the infinite impulse response (IIR) filtering process during luminance correction and image correction and increasing the time constant of the filtering process for luminance correction.

(5) The balance between the filtering process accompanying luminance adjustment control and the filtering process accompanying image correction is always maintained by calculating the amount of reduction in lighting luminance and then calculating the amount of image correction depending on the amount of reduction in luminance (i.e., employing series processing).

(6) According to the invention, power consumption can be significantly reduced by adaptive reduction in lighting luminance while minimizing deterioration in image quality (it has been confirmed that power consumption is reduced by 30% at maximum). Since the process can be implemented using minimum hardware, the space occupied by the device can be reduced.

(7) According to the invention, the added values of a driver device (driver), a control device (controller), and a drive control device (device in which a driver and a controller are integrated) of a liquid crystal display device and the like can be increased.

(8) A streaming image distributed by one-segment broadcasting and the like can be displayed with high quality and the life of a battery can be increased by mounting the image display control device (LSI) according to the invention on a portable terminal (including portable telephone terminal, PDA terminal, and portable computer terminal).

(9) According to the invention, adaptive reduction in lighting luminance and highly accurate image correction which compensates for deterioration in image quality due to a reduction in luminance can be implemented at the same time while achieving a high-speed capability (real-time capability), reducing power consumption, and suppressing an increase in circuit scale.

The invention is useful for an image display control device (image display control LSI) which adaptively reduces the luminance of display lighting corresponding to the display image and corrects an image signal to compensate for deterioration in image quality due to a reduction in luminance, a driver device (driver) of a display panel, a control device (controller) of a display panel, a drive control device (device in which a driver and a controller are integrated) of a display panel, an electronic instrument such as a portable terminal, and the like which include the image display control device.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

What is claimed is:

1. An image display control device that adaptively reduces a luminance of image display lighting corresponding to a display image and corrects an image signal to compensate for deterioration in image quality due to the reduction in the luminance of the lighting, the image display control device comprising:

a statistical information acquisition section that acquires statistical information of the image signal;

a common calculator that calculates the luminance of the lighting after reduction in luminance using the statistical information of the image signal supplied from the statistical information acquisition section, and generates a correction coefficient to correct the image signal;

a code storage section that stores a plurality of codes, the plurality of codes specifying an operation procedure of the common calculator;

a sequence instruction section that controls an order of output of the plurality of codes from the code storage section; and a decoder that decodes the plurality of codes output from the code storage section and generates at least one of an instruction and data supplied to the common calculator, the statistical information acquisition section acquiring a statistical value of a luminance of the image signal and a statistical value of a chroma of the image signal, and when calculating the luminance of the lighting after reduction in luminance, the image display control device determining whether to give priority to either a reduction in the luminance of the lighting or prevention of a decrease in the chroma based on a relationship between the statistical value of the luminance and the statistical value of the chroma, and performing luminance reduction control while limiting a reduction in the luminance of the lighting when the image display control device has determined to give priority to prevention of a decrease in the chroma.

2. The image display control device as defined in claim 1, the image display control device performing a first infinite impulse response filtering process and a second infinite impulse response filtering process during correction that reduces the luminance of the lighting and correction of the image signal using the correction coefficient, respectively, and a time constant of the first infinite impulse response filtering process performed during the correction that reduces the luminance of the lighting being set to be larger than a time constant of the second infinite impulse response filtering process performed during the correction of the image signal.

3. The image display control device as defined in claim 2, the image display control device calculating the luminance of the lighting after reduction in luminance by performing control of reducing the luminance of the lighting including the first infinite impulse response filtering process based on at least one of the statistical value of the luminance and the statistical value of the chroma, and then performing correction of the image signal including the second infinite impulse response filtering process based on the calculated luminance of the lighting.

4. The image display control device as defined in claim 2, the common calculator including a feedback path, calculation results of the common calculator being at least partially fed back to an input side of the common calculator through the feedback path.

5. A driver device of an electro-optical device, the driver device including the image display control device as defined in claim 1.

6. A control device of an electro-optical device, the control device including the image display control device as defined in claim 1.

7. A drive control device of an electro-optical device, the drive control device including the image display control device as defined in claim 1.

8. An electronic instrument including the image display control device as defined in claim 1.

* * * * *